United States Patent [19]

Blanc et al.

[11] 4,359,377

[45] Nov. 16, 1982

[54] BUSBAR ARRANGEMENT FOR ELECTROLYTIC CELLS

[75] Inventors: Jean M. Blanc, Sierre; Hans Pfister, Dübendorf, both of Switzerland

[73] Assignee: Swiss Aluminium Ltd., Chippis, Switzerland

[21] Appl. No.: 226,062

[22] Filed: Jan. 19, 1981

[30] Foreign Application Priority Data

Feb. 1, 1980 [CH] Switzerland ..... 812/80

[51] Int. Cl.[3] ..... C25C 3/16

[52] U.S. Cl. ..... 204/243 M; 204/244

[58] Field of Search ..... 204/67, 243 R–248

[56] References Cited

U.S. PATENT DOCUMENTS

| | | | |
|---|---|---|---|
| 3,650,941 | 3/1972 | Finnegan | 204/243 R |
| 3,728,243 | 4/1973 | Schmidt-Hatting | 204/244 X |
| 4,132,621 | 1/1979 | Morel et al. | 204/244 X |
| 4,210,514 | 7/1980 | Morel et al. | 204/243 R X |
| 4,224,127 | 9/1980 | Schmidt-Hatting | 204/244 X |

FOREIGN PATENT DOCUMENTS

| | | | |
|---|---|---|---|
| 887250 | 11/1971 | Canada | 204/243 M |

*Primary Examiner*—Donald R. Valentine

*Attorney, Agent, or Firm*—Bachman and LaPointe

[57] ABSTRACT

With end-to-end electrolytic cells, in particular cells for producing aluminum, high investment and operating costs are incurred by the arrangement of the busbars outside the cell. The magnetic fields produced by the busbars give rise to streaming of the metal in the cell. By providing direct connections between the individual anodes and the electrically connected busbars running along the side of the cell, in a plane just above the anodes, the costs are lowered and the harmful effects of the magnetic fields diminished. A further effect countering the magnetic forces created by the busbars can be achieved by an asymmetric arrangement in which the busbars are at different distances from the cathode bar ends or by connecting an unequal number of cathode bar ends to busbars on opposite sides of the longitudinal axis of the cell.

10 Claims, 2 Drawing Figures

BUSBAR ARRANGEMENT FOR ELECTROLYTIC CELLS

BACKGROUND OF THE INVENTION

The present invention relates to an arrangement of busbars for conducting direct electric current from the cathode bar ends of one longitudinally disposed electrolytic cell to the anodes of the next cell, in particular on cells for producing aluminum.

The electrolytic production of aluminum from aluminum oxide involves dissolving the latter in a fluoride melt, the greater part of which is made up of cryolite. The cathodically precipitated aluminum collects on the carbon floor of the cell under the fluoride melt, the surface of the liquid aluminum itself forming the cathode. Dipping into the melt from above are anodes which in conventional processes are made of amorphous carbon and are secured to the overhead anode beam. As a result of the electrolytic decomposition of the aluminum oxide, oxygen is produced at the carbon anodes. This oxygen combines with the carbon of the anodes to form $CO_2$ and CO. The electrolytic process takes place generally at a temperature of approximately 940°–970° C. In the course of the process the electrolyte becomes depleted in aluminum oxide. At a lower concentration of 1–2 wt.% aluminum oxide in the electrolyte the anode effect occurs resulting in a voltage increase from about 4–5 V to 30 V or more. Then at the latest the crust of solidified electrolyte must be broken open and the concentration of aluminum oxide increased by the addition of fresh aluminum oxide (alumina).

The normal mode of operation is such that the cell is usually serviced periodically, even when no anode effect occurs; this means that the crust is broken open and alumina added at regular intervals.

Embedded in the carbon floor of the cell are cathode bars, the ends of which project out of the long sides of the cell. These iron bars collect the electrolyzing current which flows over the busbars situated outside the cell, through the risers, the anode beams and the anode rods to the carbon anodes of the next cell. Energy losses of the order of up to 1 kWh/kg of aluminum produced are caused by the ohmic resistance between the cathode bars and the anodes. Many attempts have therefore been made to optimize the arrangement of the busbars with respect to the ohmic resistance. At the same time, however, one must take into consideration the vertical components of induced magnetic fields which, together with the horizontal current density components, create fields of force in the liquid metal produced in the reduction process.

In an aluminum smelter with end-to-end reduction cells the electric current is passed from cell to cell as follows: The direct electric current leaves the cathode bars which are embedded in the carbon floor of the cell. The ends of the cathode bars are connected via flexible strips to busbars which run parallel to the row of cells. The current is drawn from these busbars, which run along the long sides of the cells, over other flexible strips and risers to both ends of the anode beam of the next cell in the row. Depending on the type of cell, the distribution of current varies from 100–0% to 50–50%, between the nearer and further removed ends of the anode beam, with respect to the general direction of flow along the row of cells. The vertical anode rods which carry the carbon anodes and supply them with electric current are secured by bolts to the anode beam.

This busbar arrangement, which is typical in aluminum smelters is, however, to some extent inconvenient both from the electrical and magnetic standpoint.

The electric current has to be conducted a relatively long distance from the cathode bar ends of one cell to the anodes of the next cell. Viewed in the longitudinal direction of the cell a part of the electric current must be conducted in busbars to the electrically downstream end of the anode beam and then flow back through the beam. Viewed with respect to the vertical direction, the electric current is conducted from the plane of the cathode bars up to the level of the anode beam and then down to the anodes. This forwards and backwards flow of current in two directions means that more metal is required for busbars when the row of cells is built and also that during operation of the cells more energy is consumed due to ohmic resistance in the busbars.

With regard to the resultant magnetic fields the present, conventional method of supplying direct electric current to the cells is not particularly favorable. Three components of metal streaming due to magnetic effects overlap in the cell to produce movements in the liquid metal. These are:

(a) The first component, which is in principle a circular movement along the inner wall of the cell, is especially harmful with respect to the stability of the cell. This first component is caused by the neighboring row of cells which returns the electric current to the rectifier. The direction of rotation depends on whether the neighboring rows of cells lies to the left or the right of the cell in question, with respect to the general direction of current flow.

(b) The second component is due to the fact that in each half of the cell (with respect to the longitudinal direction) there is a circular streaming of the metal, the direction of rotation being different in each half. This type of rotation depends on the distribution of current between the risers.

(c) The third component is made up of rotations in the four cell quadrants, the direction of rotation being the same in diagonally opposite quarters of the cell. These rotations arise from the non-uniform distribution of current in the busbars and anode beam from one end of the cell to the other.

The overlapping of these three streaming components has the result that the rate of flow of metal varies very markedly within the cell. Where all three components act in the same direction the rate of flow of the metal in the cell is high, which causes the carbon lining to be worn away.

It is therefore an object of the invention to achieve an arrangement of busbars for conducting the direct electric current from the cathode bar ends of a longitudinally disposed electrolytic cell to the anodes of the next cell as a result of which less metallic busbar material has to be installed, smaller losses in electrical energy occur and, in addition, the deleterious magnetic effects are diminished.

SUMMARY OF THE INVENTION

This object is achieved by way of the invention in that (a) a plurality of cathode bar ends is connected, in groups, by flexible strips to a first busbar which is one of at least two such busbars running along a long side of the cell, (b) these busbars are connected electrically between the last cathode bar and the first anode of the next cell, and, starting from this equipotential connection, second busbars run along a long side of the next cell, and (c) each anode in the next cell is connected by means of a flexible strip to a second busbar running along the same long side of the cell.

BRIEF DESCRIPTION OF THE DRAWINGS

The invention is explained in greater detail in the following and with the help of the drawings viz.

DETAILED DESCRIPTION

The flexible conductor strips which are arranged close together and conduct the current from the cathode bar ends to the busbars leading to the next cell, or the current from the busbars joined to the cathode bar ends of the previous cell to the anodes, as a result of their alternating arrangement cause the third kind of streaming mentioned above to be eliminated, i.e. the rotation occurring in the four quadrants. This so-called symmetrical solution in which the busbars are at the same distance from both longitudinal sides of the cell is indeed able to prevent the magnetic effect to some extent, but not completely.

According to a preferred version of the invention therefore an effort is made to limit or eliminate the effect of the magnetic field due to the neighboring row of cells. This is achieved by an asymmetric arrangement in that the distance of the busbars from the long side of the cell on the side facing the neighboring row of cells is shorter than the distance of the busbars from the cell on the other side. The resultant asymmetry removes the magnetic effect of the neighboring row of cells and also counters the above mentioned first streaming effect along the inner periphery of the cell.

With the busbars at different distances from the long sides of the cell the flexible conductor strips, which connect the cathode bar ends to the busbars, are bent to a greater or lesser degree. When the distance of the busbar from the long side of the cell is short, these flexible strips are strongly bent; when the distance between the busbars and the long side of the cell is large they are almost stretched. This means that the electrical resistance is not changed, only the effect of the magnetic field.

Usefully, the busbars on the facing and non-facing sides of the row of cells are arranged such that the difference in their distance from the relevant long side of the cell is about 50–80 cm.

As in practice a cell need not have equal numbers of cathode bar ends and anodes, all the first busbars are connected electrically. In the electrical sense upstream and downstream from the equipotential connection the cross section of the first and second busbar is chosen such that the electrical resistance of all busbars is approximately the same. The short busbars can have a smaller cross section than the longer busbars. Instead of this the busbars can be made of metals of different electrical resistivity, whereby the shortest busbars would have the largest specific electrical resistivity and the longest the smallest resistivity.

The asymmetric arrangement may also be realized by connecting a different number of cathode bar ends to the first busbars on opposite sides of the longitudinal axis of the cell.

Figure 1:
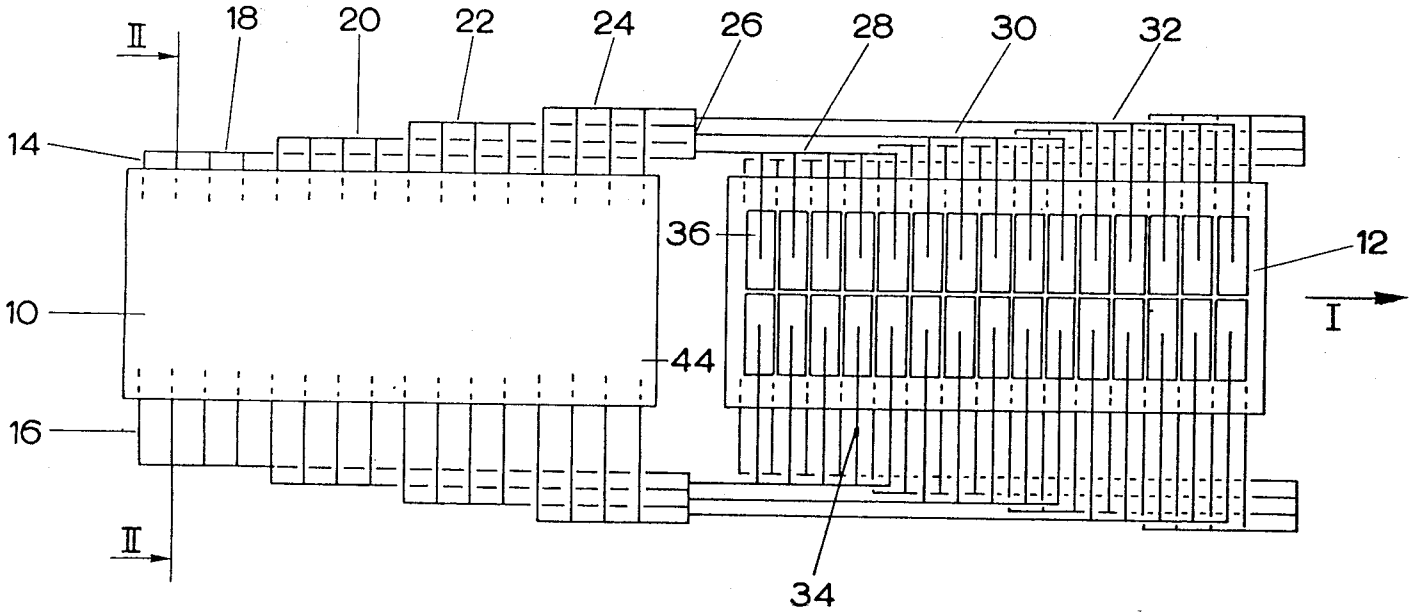
FIG. 1: A layout of busbars leading from the cathode bar ends of one cell to the anodes of the next cell, with the current path from the cathode bar ends of the next cell also shown.
Figure 2:
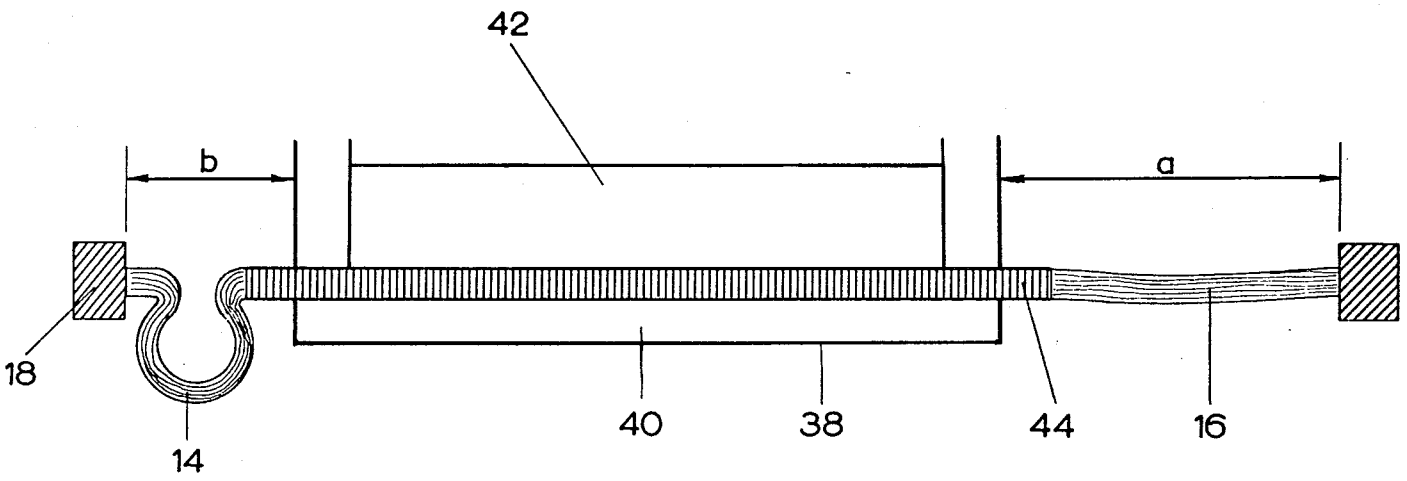
FIG. 2: A schematic vertical cross section at II—II in FIG. 1 transverse to the longitudinal direction of the cell.

The electrolytic cells 10 and 12 shown in FIG. 1 represent two consecutive cells from a row of end-to-end cells in an aluminum smelter. The general direction of flow of the direct electric current is indicated by I. The neighboring row of cells which exerts a magnetic effect on the cells 10 and 12 is situated to the left with respect to the general direction of current flow I. The cathode bars embedded in the carbon floors of cells 10 and 12 are only indicated schematically. Provided, at both ends of the cathode bars are flexible conductor strips 14,16. As shown in FIG. 2, when the busbars 18,20,22 and 24 are close to the adjacent side of the cell, the flexible conductor strips are strongly bent. Where the busbars are on the opposite side of the longitudinal axis of the cell, the strips are far from the adjacent side of the cell and are almost stretched. The busbars 18,20,22 and 24 are short-circuited at the connection 26. Three busbars 28,30 and 32 running along the side of the next cell 12 are connected electrically to the equipotential connection 26. Flexible conductor strips 34 branch off from these busbars and such that a strip from each connects up with an anode beam not shown here. The anodes are shown at 36. The busbar 28 conducts the current to the nearest anode, busbar 30 to the middle anode and busbar 32 to the most distant, with respect to direction I, anodes of the next cell 12. All busbars preferably have the same electrical resistance, whereby if all busbars are made of the same material the bars 24 and 28 have the smallest cross section and bars 18 and 32 the largest.

Of course the cell 10 is also fitted with anodes 36 and the corresponding current supply. These have been omitted here to simplify the diagram.

In the present case a cell features 32 cathode bar ends but has only 30 anodes. If the distribution of current is to be uniform an equipotential connection 26 must be provided when the number of cathode bar ends and anodes is not equal.

In FIG. 2 the numeral 38 indicates the steel shell, 40 the thermal insulation, 42 the carbon floor and 44 the cathode bar ends; a the larger distance of the busbar 18, b the shorter distance from the respective sidewalls of the cell.

The present invention has the following advantages:

(a) The route for the direct electric current from a cathode bar end to an anode in the next cell is shorter, and approximately 2 m per busbar can be saved, which results in lower investment costs because less material is required, and also operational costs are lowered because of the lower consumption of energy due to the lower electrical resistance.

(b) Cell operation is more stable, which results in a further reduction of energy losses and/or a possibility to increase production.

(c) There is less wear on the cathode lining, and consequently an increase in the service life of the cell.

What is claimed is:

1. Arrangement of busbars for conducting direct electric current from the cathode bar ends of a longitudinally disposed electrolytic cell to the anodes of the next cell which comprises: first busbars running along a long side of a first cell; flexible strips connecting in groups a plurality of cathode bar ends of said first cell to said first busbars; an equipotential electrical connection between the last cathode bar of the first cell and the first anode of the next cell; second busbars starting from said equipotential connection running along the long side of the next cell; and flexible strips connecting each anode in the next cell to said second busbars, whereby an arrangement of busbars is provided which uses less metallic busbar material, obtains smaller losses in electrical energy and diminishes deleterious magnetic effects.

2. Arrangement of busbars according to claim 1 wherein the first and second busbars are positioned, on both sides of the cells, the same distance from their respective sides of the cells.

3. Arrangement of busbars according to claim 1 wherein all the electrical resistance of all first busbars between the cathode bar ends and the equipotential connection is approximately the same.

4. Arrangement of busbars according to claim 3 wherein the electrical resistance in all the second busbars between the equipotential connection and the connections to the anodes to be supplied with current is approximately equal.

5. Arrangement of busbars according to claim 4 wherein the shortest busbars have the smallest cross section and the longest busbars the largest cross section.

6. Arrangement of busbars according to claim 4 wherein the shortest busbars have the largest specific electrical resistivity and the longest busbars the smallest electrical resistivity.

7. Arrangement of busbars according to claim 1 wherein the electrical resistance in all the second busbars between the equipotential connection and the connections to the anodes to be supplied with current is approximately equal.

8. Arrangement of busbars according to claim 1 wherein a different number of cathode bar ends is connected to the first busbars on opposite sides of the longitudinal axis of the cell.

9. Arrangement of busbars for conducting direct electric current from the cathode bar ends of a longitudinally disposed electrolytic cell to the anodes of the next cell which comprises: first busbars running along a long side of a first cell; flexible strips connecting in groups a plurality of cathode bar ends of said first cell to said first busbars; an equipotential electrical connection between the last cathode bar of the first cell and the first anode of the next cell; second busbars starting from said equipotential connection running along the long side of the next cell; and flexible strips connecting each anode in the next cell to said second busbars, wherein the first and second busbars on the side facing the neighboring row of cells are closer to the long side of the cell than those on the side facing away from the neighboring row of cells.

10. Arrangement of busbars according to claim 9 wherein the difference between the larger distance (a) and the smaller distance (b) of the busbars from their respective long sides of the cell is 50–80 cm.

* * * * *